US010941533B2

(12) United States Patent
French

(10) Patent No.: US 10,941,533 B2
(45) Date of Patent: Mar. 9, 2021

(54) SHOVEL ASSEMBLY

(71) Applicant: Nicholas French, Doulas, MI (US)

(72) Inventor: Nicholas French, Doulas, MI (US)

( * ) Notice: Subject to any disclaimer, the term of this patent is extended or adjusted under 35 U.S.C. 154(b) by 0 days.

(21) Appl. No.: 15/718,404

(22) Filed: Sep. 28, 2017

(65) Prior Publication Data

US 2018/0087229 A1 Mar. 29, 2018

Related U.S. Application Data

(60) Provisional application No. 62/401,503, filed on Sep. 29, 2016.

(51) Int. Cl.
*E01H 5/02* (2006.01)
*B25G 1/01* (2006.01)

(52) U.S. Cl.
CPC ..... *E01H 5/02* (2013.01); *B25G 1/01* (2013.01)

(58) Field of Classification Search
CPC .. E01H 5/02; B25G 1/01; A01B 1/028; A01B 1/04; E04D 13/106
USPC ..... 294/54.5, 56, 59
See application file for complete search history.

(56) References Cited

U.S. PATENT DOCUMENTS 845,549 A * 2/1907 Henry
2,823,470 A * 2/1958 Page ..... E01H 5/02 294/181
2,933,836 A 4/1960 McKinley
3,078,604 A * 2/1963 Neuman ..... E01H 5/02 294/54.5
3,218,738 A * 11/1965 Bowerman ..... E04D 13/106 294/54.5
3,222,699 A * 12/1965 Zeisig ..... E01H 5/02 294/51
3,483,643 A * 12/1969 Wenzel ..... E01H 5/02 15/236.01
4,149,744 A 4/1979 Bonnes
4,199,181 A 4/1980 Mason
4,280,727 A 7/1981 Germain
4,531,713 A 7/1985 Balboni
4,559,726 A 12/1985 Moisan
4,804,219 A 2/1989 Berg
4,865,373 A * 9/1989 Hudson ..... E01H 5/02 294/54.5
4,985,961 A 1/1991 Kegley
4,991,324 A 2/1991 Fine et al.
5,271,169 A 12/1993 Konsztowicz
(Continued)

OTHER PUBLICATIONS

The first Office Action dated Sep. 25, 2018, issued by the Canadian Intellectual Property Office for Canadian Patent Application No. 2,980,872.

*Primary Examiner* — Dean J Kramer
(74) *Attorney, Agent, or Firm* — King & Partners, PLC

(57) ABSTRACT

A shovel assembly including: an elongated shaft, wherein the elongated shaft includes a length, a first proximal end, and a second distal end; a handle sub-assembly, wherein the handle sub-assembly is secured to or forms part of the first proximal end of the elongated shaft; a blade implement, wherein the blade implement is secured to or forms part of the second distal end of the elongated shaft; and a blade implement guide member associated with the blade implement, wherein the blade implement guide member enables the removal of snow from uneven surfaces without jarring the operator.

10 Claims, 10 Drawing Sheets

(56) References Cited

U.S. PATENT DOCUMENTS 5,348,360 A * 9/1994 Mencarelli ..... B25G 1/01 16/421
5,440,828 A 8/1995 Simpson
D381,375 S 7/1997 Spear et al.
5,727,830 A * 3/1998 Asher ..... E01H 5/02 294/54.5
D395,212 S 6/1998 Vosbikian
5,782,518 A * 7/1998 Scruggs ..... A01B 1/02 15/143.1
5,791,072 A 8/1998 Schbot
5,810,408 A 9/1998 Armstrong
5,816,632 A * 10/1998 Baldacci ..... A01B 1/04 294/51
5,826,929 A * 10/1998 Tisbo ..... E01H 5/02 294/54.5
5,906,060 A * 5/1999 Tonry ..... E01H 5/02 294/54.5
5,975,602 A * 11/1999 Zan ..... E01H 5/02 294/54.5
D433,889 S 11/2000 Spear
6,269,558 B1 8/2001 Alexander
6,290,273 B1 9/2001 Moisan
6,334,640 B1 1/2002 Werner et al.
D477,755 S 7/2003 Markley
7,121,599 B2 * 10/2006 Demar ..... A01B 1/02 294/60
7,237,814 B2 7/2007 Handzlik
D553,920 S 10/2007 Rosine
D558,004 S 12/2007 Kelly, Jr.
7,305,779 B1 12/2007 Purvis
D572,094 S 7/2008 Rosine et al.
7,581,771 B2 * 9/2009 Rosine ..... A01B 1/02 294/54.5
8,166,677 B1 5/2012 Woyak
D676,723 S 2/2013 Norwood et al.
D708,495 S 7/2014 Stein
8,800,175 B1 8/2014 Farad et al.
D718,100 S 11/2014 Masalin et al.
D758,152 S 6/2016 Blouin et al.
D782,888 S 4/2017 Philenza
D809,353 S 2/2018 Blouin et al.
2004/0222652 A1 * 11/2004 Colville ..... E01H 5/02 294/54.5
2005/0160632 A1 7/2005 Williams
2005/0184542 A1 * 8/2005 Moreschini ..... E01H 5/02 294/54.5
2006/0249964 A1 11/2006 Brazeau
2007/0145756 A1 * 6/2007 DeWinter ..... E01H 5/02 294/54.5
2011/0181065 A1 7/2011 Pavlic
2011/0198875 A1 * 8/2011 Smith ..... E01H 5/02 294/54.5
2013/0119684 A1 * 5/2013 Ceja ..... A01B 1/04 294/54.5

* cited by examiner

SHOVEL ASSEMBLY

CROSS-REFERENCE TO RELATED APPLICATIONS

This application claims the benefit of U.S. Provisional Application Ser. No. 62/401,503, filed Sep. 29, 2016, entitled "SHOVEL ASSEMBLY," which is hereby incorporated herein by reference in its entirety—including all references and appendices cited therein.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates in general to shovel assemblies, and, more particularly, to shovel assemblies that enable the removal of snow from uneven or cracked sidewalks, driveways, and the like, without jarring the operator. The shovel assemblies of the present invention preferably comprise, an optional handle, an elongated shaft, a blade implement, and one or more blade implement guide members.

2. Background Art

Shovel assemblies have been known in the art for years and are the subject of a plurality of patents and/or publications, including: U.S. Pat. No. 7,305,779 entitled "Snow-Shoveling Apparatus," U.S. Pat. No. 6,334,640 entitled "Snow Shovel System," U.S. Pat. No. 6,290,273 entitled "Articulated Snow Shovel," U.S. Pat. No. 5,975,602 entitled "Contoured Snow Shovel Construction," U.S. Pat. No. 4,991,324 entitled "Snow Removal Device," U.S. Pat. No. 4,559,726 entitled "Snow Mover," U.S. Pat. No. 4,280,727 entitled "Injection Molded Snow Shovel," U.S. Pat. No. 4,199,181 entitled "Snow Shovel," U.S. Pat. No. 4,149,744 entitled "Snow Shovel," U.S. Patent Application Publication Number 2006/0249964 entitled "Snow Shovel," and U.S. Patent Application Publication Number 2005/0160632 entitled "Snow Shovel"—all of which are hereby incorporated herein by reference in their entirety including all references cited therein.

U.S. Pat. No. 7,305,779 appears to disclose an apparatus that has proximal and distal end portions. The shaft includes spaced grip covers conjoined about an outer surface thereof and is provided with a centrally registered sleeve formed therein. An arcuately shaped plow section is affixed to the distal end portion and includes a heel support that has an arcuately shaped top surface for assisting to maintain the plow section registered along a horizontal plane. The plow section further includes fastening members spaced along the bottom edge for removing the bottom edge to be sharpened or replaced. The apparatus further includes a mechanism for pivoting the plow section between alternate radial paths during operating conditions. A mechanism is included for automatically biasing the plow section to an equilibrium position after the plow section is biased to a pivoted position.

U.S. Pat. No. 6,334,640 appears to disclose a snow shovel system for removing snow from a surface without requiring significant physical effort by a user. The snow shovel system includes a blade member having a first edge and a second edge, a frame attached to a rear surface of the blade member, a handle pivotally attached to the frame, and a wheel rotatably attached to the frame for maintaining the blade member in a substantially horizontal position. The handle may be rotated approximately 180 degrees with respect to the blade member for allowing the user to select which edge of the blade member will be utilized to engage the surface to be cleaned of snow which determines whether the snow is pushed to the left side or right side of the user during a forward movement.

U.S. Pat. No. 6,290,273 appears to disclose a manual snow discarding device that takes into account the security and the efficiency of the snow discarding operation. The device includes at a lower extremity of a shaft an angularly adjustable bent section having a lower end essentially vertically oriented and curved to assume the shape of part of the back of a concave blade, thereby physically increasing the height of a handle at the upper extremity of the shaft for a same angle between the shaft and a horizontal line. The shaft is also secured in place by a securing member, allowing to alternatively position the shaft of the shovel at different angles with respect to the blade depending on the use of the shovel that is to be performed and/or depending on the height of the user. This also enables persons of a large range of height to be able to use the shovel effectively with various angles to be given on the blade.

U.S. Pat. No. 5,975,602 appears to disclose a snow shovel construction including a curved and tapered blade member having an enlarged end and a smaller end. The blade member is disposed at an angle of approximately 60 degrees relative to a handle member that is provided with a pair of offset hand grip elements and further provided with a reinforcement unit disposed both on the blade member and between the blade member and the handle member.

U.S. Pat. No. 4,991,324 appears to disclose a manual snow removal device having horizontally adjustably engageable component working surfaces allowing it to clear a wide or narrow swath depending on the operator capabilities, snow depth or weight and whether a sidewalk or drive way is being cleared. Handles, which can be pivoted or extended, are affixed to the device to facilitate manual use.

U.S. Pat. No. 4,559,726 appears to disclose snow handling equipment comprising a handle grip, a tubular handle, a blade slightly curved in cross section and rectangular in plan and a supporting device securing the blade to the handle. The supporting device allows the pivoting movement of the blade in a plane perpendicular with respect to the plane of the handle to allow the user to adjust the angle of the blade or turn the blade upside down in order to use either edge of the blade to scrape the snow.

U.S. Pat. No. 4,280,727 appears to disclose a one piece plastic injection molded snow shovel in which the blade, synthetic plastic handle stem and D-top handle are molded in one operation and a finished unit is produced from one cycle of the molding machine. A generally rectangular scoop of synthetic plastic has an integral generally cylindrical hollow handle stem extending centrally outwardly from the rear edge of the scoop. One embodiment has an inwardly reinforced cylindrical stem extending inward of the scoop for several inches from the back edge and then outward for a space normally grasped by a hand of the shoveller. A second embodiment has the handle stem entering from the back of the scoop with a section including an arcuate shell having an arc between about 220 degrees to 235 degrees and with a central reinforcing rib diametetrically of the arc. The outwardly extending handle stem consists of upwardly opening arcuate shell between about 220 degrees to 235 degrees together with an upper face of an open X-crossing structure making a light but strong handle. A third embodiment has a hollow cylindrical handle stem of which almost the entire length has a plurality of spaced longitudinally extending short reinforcing projections extending radially inwardly.

U.S. Pat. No. 4,199,181 appears to disclose a device for removing snow from sidewalks, driveways, and the like. The device is used principally as a plow for pushing the snow off to one side of a snow-covered path. Force which is applied through the handle of the device is distributed over the blade equally so that the blade will not veer from the path to be plowed. The blade is formed from a trapezoidal blank and is diagonally curved to give a sidewise thrust to the snow as it is pushed along the path to be cleaned.

U.S. Pat. No. 4,149,744 appears to disclose a snow shovel including a handle and a one-piece plastic scoop so formed of a minimum amount of material as to resist wear and breakage effectively. The shovel has a self-sharpening reinforcing leading edge, a reinforcing flange at the remainder of its peripheral edge, a series of laterally-spaced reinforcing ribs extending from the leading edge rearwardly, and a centrally-disposed reinforcing keel or rib on its back surface extending from the leading edge to its handle-receiving socket. The shovel also has crush ribs in the socket to allow the handle dimensional variations, prevent rotation of the scoop on the handle, and maintain a snug fit.

United States Patent Application Publication Number 2006/0249964 appears to disclose a snow shovel/pusher for pushing snow forward or to one side or the other, the snow shovel having a blade and a shaft wherein the blade is connected to the shaft with a yoke mechanism for pivotally retaining the shovel blade at various side to side angles relative to the shaft, the shovel blade being pivotable relative to the shaft in a horizontal plane on a vertical central blade axis perpendicular to the working surface. The yoke mechanism is angled upward relative to the working surface to retain the shaft at a constant desirable working angle with respect to the working surface during use and during pivotal movement of the shovel blade relative to the shaft. The snow shovel also includes a releasable locking mechanism operable for releasing and relocking the shovel blade at various side to side angles relative to said shaft between an extreme right and an extreme left position.

United States Patent Application Publication Number 2005/0160632 appears to disclose a snow shovel that scoops up a pile of snow, pivot and wheels the contents to another location, whereupon operation of a lever releases its load. The telescoping frame and rotatable handle provides a selection of lockable positions. The front mounted scoop head is pivotally mounted to the lower end of the frame. Upon activation of a release lever, the scoop head is allowed to rotate downward, releasing its load. A wheel assembly mounted to an intermediate portion of the frame supports the shovel in an inclined position, allowing the user to concentrate on applying force in a forward direction rather than expending effort lifting the handle. Furthermore, the wheel assembly acts as a fulcrum whereby downward pressure on the handlebars of the shovel elevates the scoop for ease of transport. The wheel assembly may be rotated towards the frame when not in use.

Notwithstanding the foregoing, none of the prior art references teach or render obvious the snow shovel assemblies and/or apparatuses of the present invention. In particular, the snow shovel assemblies of present invention are configured to protect a user while shoveling uneven or cracked surfaces.

These and other objects of the present invention will become apparent in light of the present specification, claims, and appended drawings.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be further understood that the invention is not necessarily limited to the particular embodiments illustrated herein.

The invention will now be described with reference to the drawings wherein.

SUMMARY OF THE INVENTION

Figure 1:
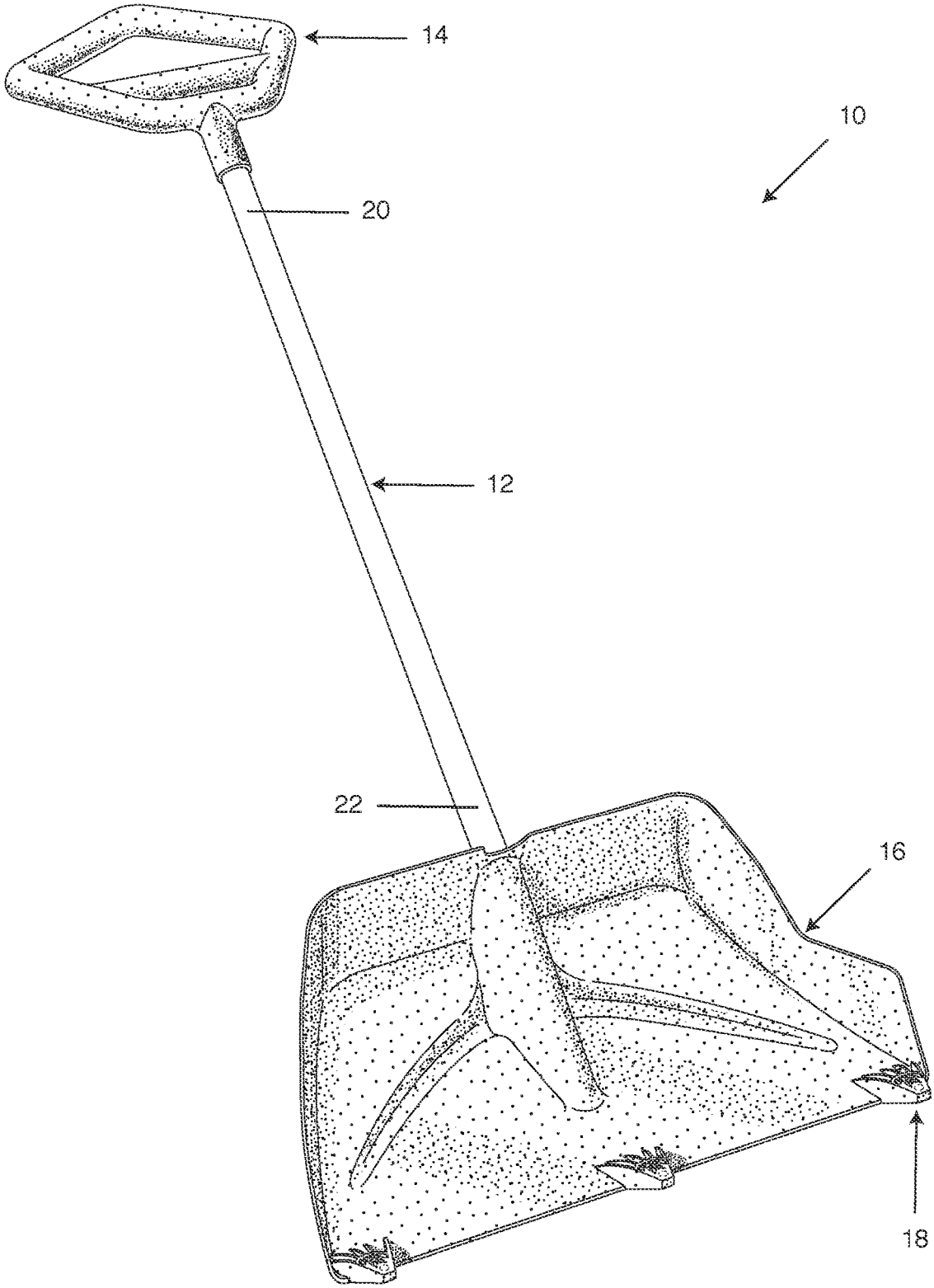
FIG. 1 is a front perspective view of a shovel assembly fabricated in accordance with the present invention.
Figure 2:
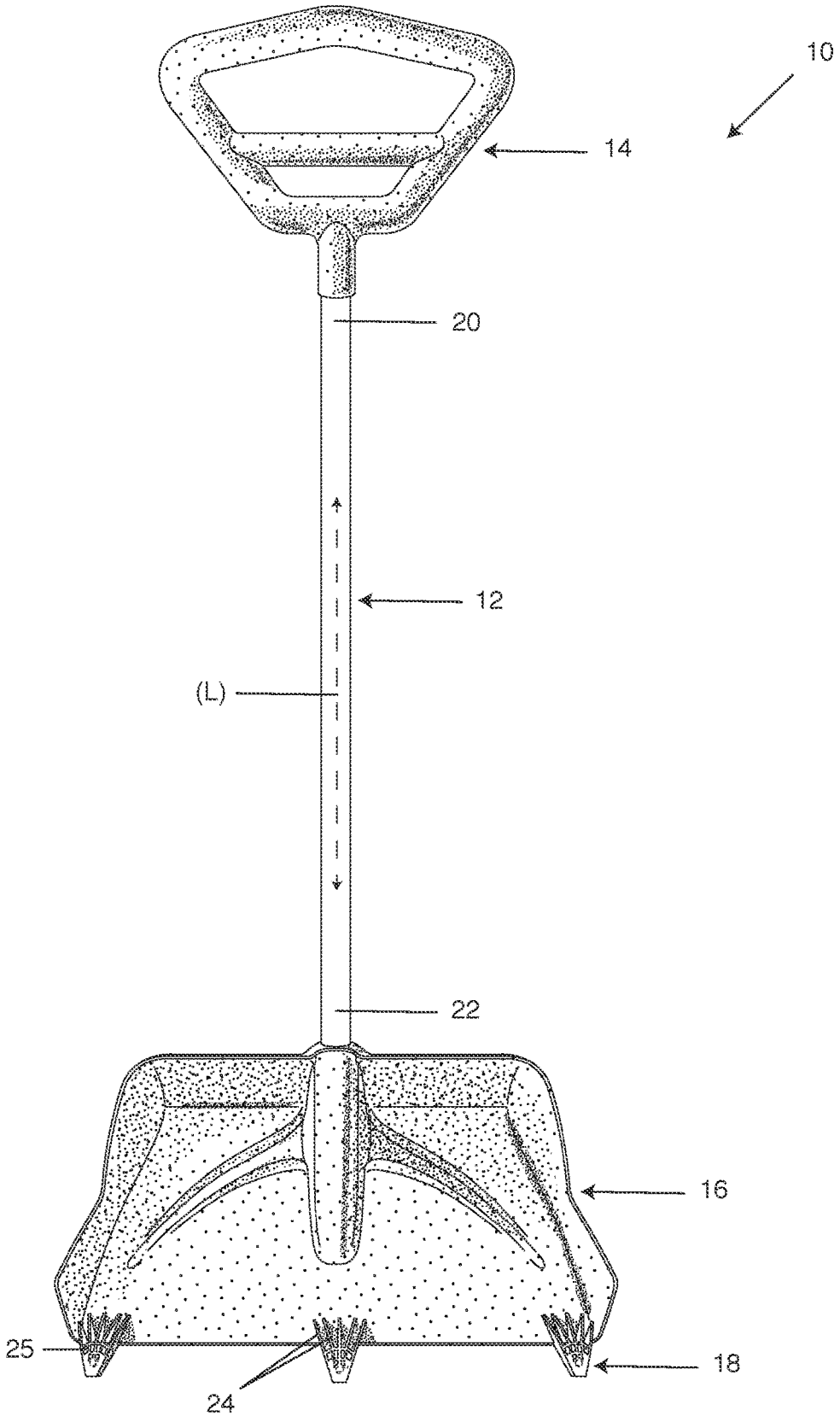
FIG. 2 is a front view of the shovel assembly of FIG. 1.
Figure 3:
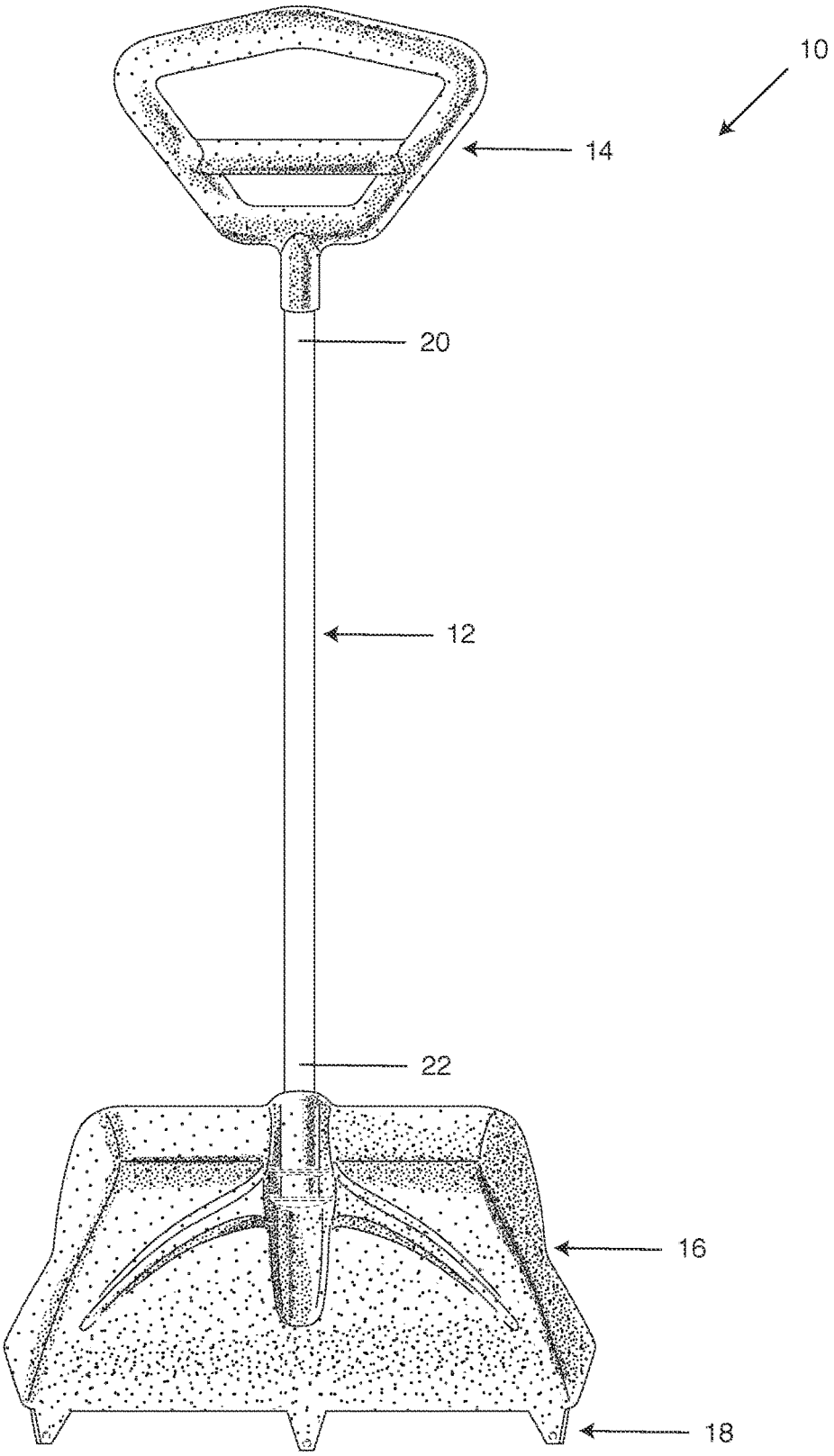
FIG. 3 is a rear view of the shovel assembly of FIG. 1.

The present invention is directed to, in one embodiment, a shovel assembly comprising, consisting essentially of, and/or consisting of: (a) an elongated shaft, wherein the elongated shaft comprises a length, a first proximal end, and a second distal end; (b) a blade implement, wherein the blade implement is secured to or forms part of the second distal end of the elongated shaft; and (c) a blade implement guide member associated with the blade implement. In this embodiment, the blade implement guide member enables the removal of snow from uneven surfaces without jarring the operator.

In a preferred embodiment of the present invention, the elongated shaft is fabricated from a material selected from the group consisting of a metal, an alloy, a natural resin, a synthetic resin, a plastic, a composite, and/or wood.

In another preferred embodiment of the present invention, the elongated shaft is at least partially coated with at least one shock absorbing material selected from the group consisting of a natural polyisoprene, a synthetic polyisoprene, a polybutadiene, a chloroprene rubber, a butyl rubber, a halogenated butyl rubber, a styrene-butadiene rubber, a nitrile rubber, a hydrogenated nitrile rubber, an ethylene propylene rubber, an ethylene propylene diene rubber, an epichlorohydrin rubber, a polyacrylic rubber, a silicone rubber, a fluorosilicone rubber, a fluoroelastomer, a perfluoroelastomer, a polyether block amide, a chlorosulfonated, ethylene-vinyl acetate, a resilin, an elastin, a polysulfide rubber, an elastolefin, and combinations thereof.

In yet another preferred embodiment of the present invention, the shovel assembly further comprises a handle sub-assembly. In this embodiment, the handle sub-assembly is secured to or forms part of the first proximal end of the elongated shaft. Examples of handle sub-assemblies comprise C-top, D-top, E-top and O-top handles.

In a preferred embodiment of the present invention, the handle sub-assembly is fabricated from a material selected from the group consisting of a metal, a natural resin, a synthetic resin, a plastic, a composite, and/or wood.

In another preferred embodiment of the present invention, the handle sub-assembly is at least partially coated with at least one shock absorbing material selected from the group consisting of a natural polyisoprene, a synthetic polyisoprene, a polybutadiene, a chloroprene rubber, a butyl rubber, a halogenated butyl rubber, a styrene-butadiene rubber, a nitrile rubber, a hydrogenated nitrile rubber, an ethylene propylene rubber, an ethylene propylene diene rubber, an epichlorohydrin rubber, a polyacrylic rubber, a silicone rubber, a fluorosilicone rubber, a fluoroelastomer, a perfluoroelastomer, a polyether block amide, a chlorosulfonated, ethylene-vinyl acetate, a resilin, an elastin, a polysulfide rubber, an elastolefin, and combinations thereof.

In yet another preferred embodiment of the present invention, the blade implement is fabricated from a material selected from the group consisting of a metal, an alloy, a natural resin, a synthetic resin, a plastic, a composite, and/or wood.

In another aspect of the present invention, the blade implement is at least partially coated with a non-stick agent. In this embodiment, the non-stick agent is selected from the group consisting of a polytetrafluoroethylene and/or fluorinated ethylene propylene.

In a preferred embodiment of the present invention, the blade implement guide member emanates forward and away from the blade implement, and optionally is flush with and upward extending from a bottom surface of the blade implement.

In another preferred embodiment of the present invention, the blade implement guide member consists of three guide members emanating forward and away from the blade implement.

In yet another preferred embodiment of the present invention, the blade implement guide member is integrated with and/or forms part of the blade implement.

In another aspect of the present invention, the blade implement guide member comprises at least two guide members associated with left and right side walls of the blade implement. In this embodiment, the blade implement guide member preferably comprises at least two guide members integrated into the left and right sidewalls of the blade implement.

In a preferred embodiment of the present invention, the blade implement guide member is at least partially covered by a wear strip.

The present invention is also directed to, in one embodiment, a shovel assembly comprising, consisting essentially of, and/or consisting of: (a) an elongated shaft, wherein the elongated shaft comprises a length, a first proximal end, and a second distal end; (b) a handle sub-assembly, wherein the handle sub-assembly is secured to or forms part of the first proximal end of the elongated shaft; (c) a blade implement, wherein the blade implement is secured to or forms part of the second distal end of the elongated shaft; and (d) a blade implement guide member associated with the blade implement, wherein the blade implement guide member enables the removal of snow from uneven surfaces without jarring the operator.

The present invention is further directed to, in one embodiment, a shovel assembly comprising, consisting essentially of, and/or consisting of: (a) an elongated shaft, wherein the elongated shaft comprises a length, a first proximal end, and a second distal end; (b) a handle sub-assembly, wherein the handle sub-assembly is secured to or forms part of the first proximal end of the elongated shaft; (c) a blade implement, wherein the blade implement is secured to or forms part of the second distal end of the elongated shaft; (d) a wear strip, wherein the wear strip is associated with the blade implement; and (e) a blade implement guide member associated with the blade implement, wherein the blade implement guide member enables the removal of snow from uneven surfaces without jarring the operator.

DETAILED DESCRIPTION OF THE INVENTION

While this invention is susceptible of embodiment in many different forms, there is shown in the drawings and will be described herein in detail, one or more specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

Referring now to the drawings, and to FIGS. 1-6 collectively, shovel assembly 10 is shown as generally comprising elongated shaft 12, handle sub-assembly 14, blade implement 16, and one or more blade implement guide members 18. In accordance with the present invention, shovel assembly 10 is configured to enable a user to remove, for example, snow from uneven surfaces without jarring the operator.

Elongated shaft 12 comprises length (L), first proximal end 20, and second distal end 22. Elongated shaft 12 is preferably fabricated from, for example, metals (e.g. aluminum, tin, copper, nickel, titanium, steel, and alloys thereof), natural resins, synthetic resins, plastics, composites, woods, and mixtures thereof. In one embodiment, elongated shaft 12 is at least partially coated (e.g., dip coated, spin coated, brush coated and/or spray coated—including, but not limited to, cold spraying, thermal spraying, high velocity spraying (e.g., supersonic), low velocity spraying (e.g., subsonic), triboelectric discharge kinetic spraying and other similar processes) with at least one shock absorbing material selected from the group consisting of a natural polyisoprene, a synthetic polyisoprene, a polybutadiene, a chloroprene rubber, a butyl rubber, a halogenated butyl rubber, a styrene-butadiene rubber, a nitrile rubber, a hydrogenated nitrile rubber, an ethylene propylene rubber, an ethylene propylene diene rubber, an epichlorohydrin rubber, a polyacrylic rubber, a silicone rubber, a fluorosilicone rubber, a fluoroelastomer, a perfluoroelastomer, a polyether block amide, a chlorosulfonated, ethylene-vinyl acetate, a resilin, an elastin, a polysulfide rubber, an elastolefin, and combinations thereof.

Figure 7:
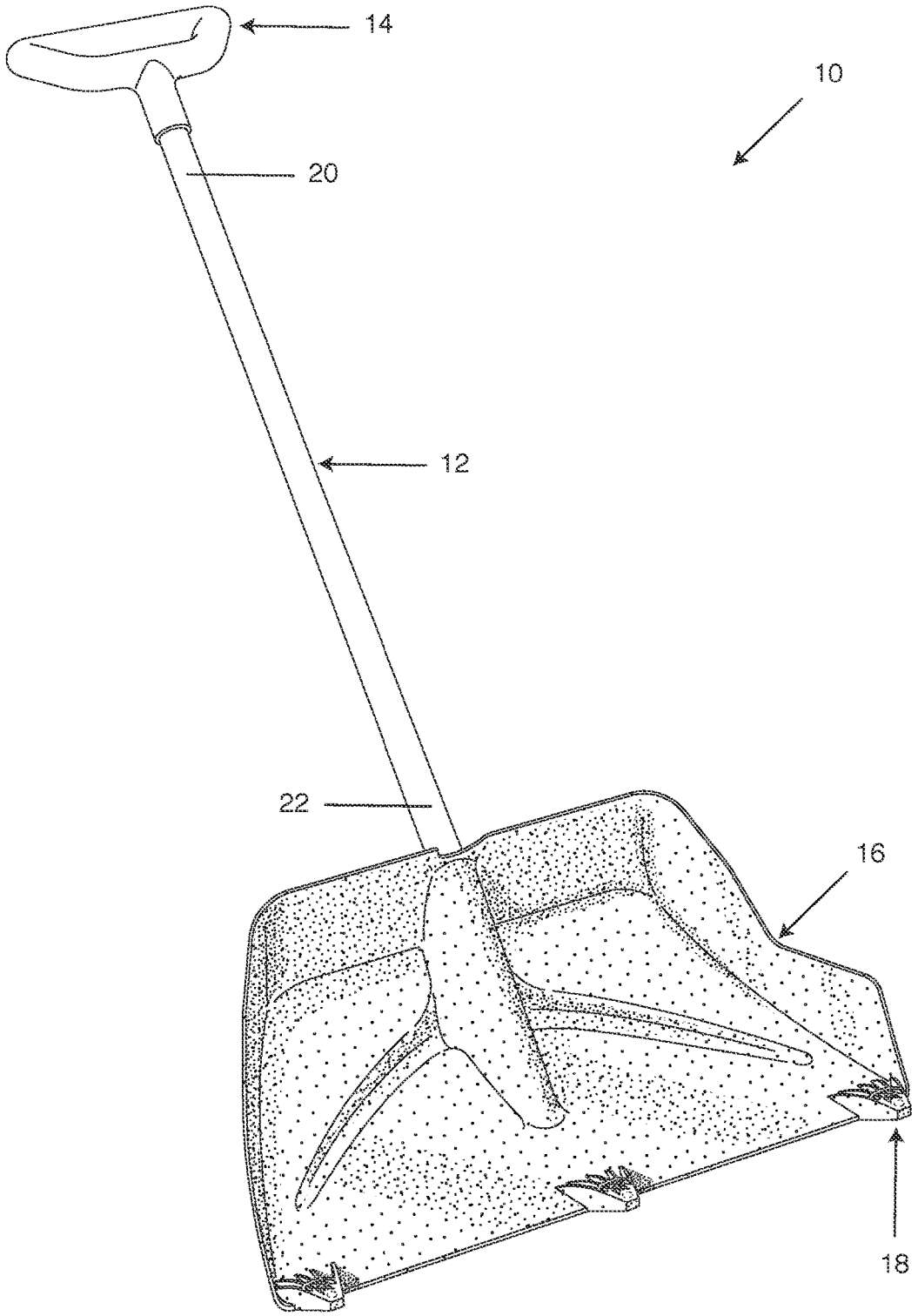
FIG. 7 is a front perspective view of an alternative embodiment of a shovel assembly fabricated in accordance with the present invention.

Handle sub-assembly 14 is preferably secured to or (if integrally fabricated) forms part of first proximal end 20 of elongated shaft 12. Handle sub-assembly 14 preferably comprises a C-top, D-top (See FIG. 7), E-top or O-top handle, and is preferably fabricated from, for example, metals (e.g., aluminum, tin, copper, nickel, titanium, steel, and alloys thereof), natural resins, synthetic resins, plastics, composites, woods, and mixtures thereof.

In another preferred embodiment of the present invention, the handle sub-assembly 14 is at least partially coated with at least one shock absorbing material selected from the group consisting of a natural polyisoprene, a synthetic polyisoprene, a polybutadiene, a chloroprene rubber, a butyl rubber, a halogenated butyl rubber, a styrene-butadiene rubber, a nitrile rubber, a hydrogenated nitrile rubber, an ethylene propylene rubber, an ethylene propylene diene rubber, an epichlorohydrin rubber, a polyacrylic rubber, a silicone rubber, a fluorosilicone rubber, a fluoroelastomer, a perfluoroelastomer, a polyether block amide, a chlorosulfonated, ethylene-vinyl acetate, a resilin, an elastin, a polysulfide rubber, an elastolefin, and combinations thereof.

Blade implement 16 is preferably secured to or (if integrally fabricated) forms part of second distal end 22 of elongated shaft 12. Blade implement 16 preferably comprises a snow blade, plow, scoop, or other removal implement, and optionally comprises reflective members and/or tape (not shown). Typically, blade implement 16 includes a bottom wall having a top surface and a bottom surface, a rear wall having a front surface and a rear surface, and optional side walls having inner and outer surfaces. Preferably the sidewalls of blade implement 16 in cooperation with the rear wall retain a significance amount of matter or snow during normal use. Blade implement 16 is preferably fabricated from, for example, metals (e.g., aluminum, tin, copper, nickel, titanium, steel, and alloys thereof), natural resins, synthetic resins, plastics, composites, woods, and mixtures thereof.

In a preferred embodiment of the present invention, blade implement 16 is at least partially coated with a substantially non-stick or non-stick agent. In this embodiment, the non-stick agent is selected from the group consisting of a synthetic fluoropolymer (e.g., polytetrafluoroethylene) and/or a copolymer of hexafluoropropylene and tetrafluoroethylene (e.g., fluorinated ethylene propylene).

In a preferred embodiment of the present invention, one or more blade implement guide members 18 are associated with blade implement 16. During normal operation (e.g., forward displacement of shovel assembly 10 away from the user) one or more blade implement guide members 18 enables the removal of snow from uneven surfaces without jarring the operator. It will be understood that blade implement guide members 18 serve as a span member for shovel assembly 10—especially when an upcoming surface is raised relative to the current position of shovel assembly 10. Such a span, similar to a snowmobile ski, enables the user to avoid abrupt stops and/or jarring while shoveling snow.

In a preferred embodiment of the present invention, blade implement guide members 18 emanate forward and away from blade implement 16, and optionally are flush with and upward extending from a bottom surface of blade implement 16.

In another preferred embodiment of the present invention, blade implement guide members 18 consists of three separate guide members emanating forward and away from blade implement 16. The guide members preferably include a plurality of ribs or tines 24 and apertures 25, which both strengthen guide members 18, and during normal operation, provide for an enhanced spring effect for facilitating displacement over uneven surfaces.

In accordance with one embodiment of the present invention, blade implement guide members 18 are integrated with and/or form part of blade implement 16. It will be understood that blade implement guide members 18 may be associated with, integrated with, and/or form part of a base and/or sidewalls of the blade implement. In this embodiment, blade implement guide members 18 preferably extend beyond the front surface of the blade implement.

Figure 8:
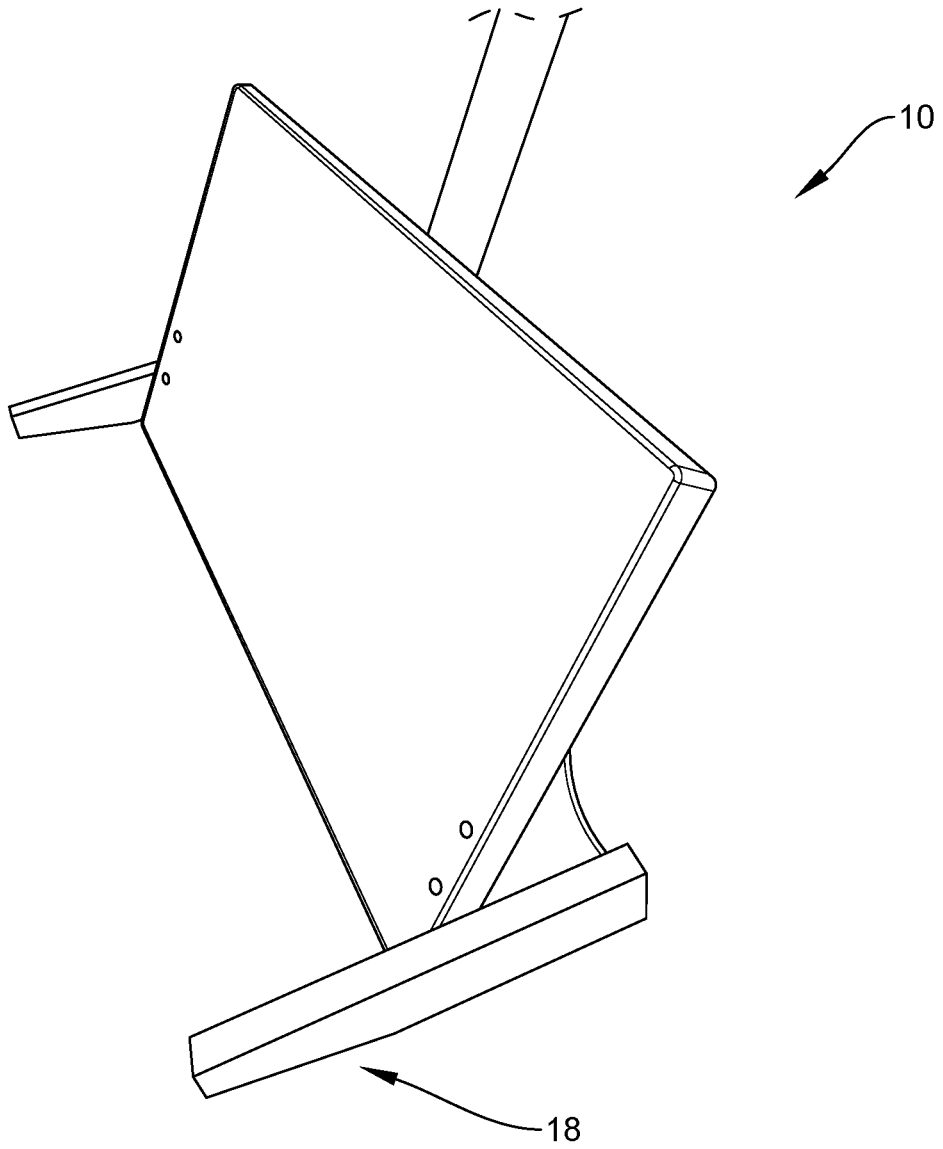
FIG. 8 is a front perspective view of a shovel assembly fabricated in accordance with the present invention showing the blade implement guide member associated with the side walls of the blade implement.

Referring now to FIG. 8, and in another aspect of the present invention, the blade implement guide member may comprise at least two guide members 18 associated with left and right side walls of blade implement 16. In this embodiment, the blade implement guide member optionally comprises at least two guide members integrated into left and right sidewalls of the blade implement.

Figure 9:
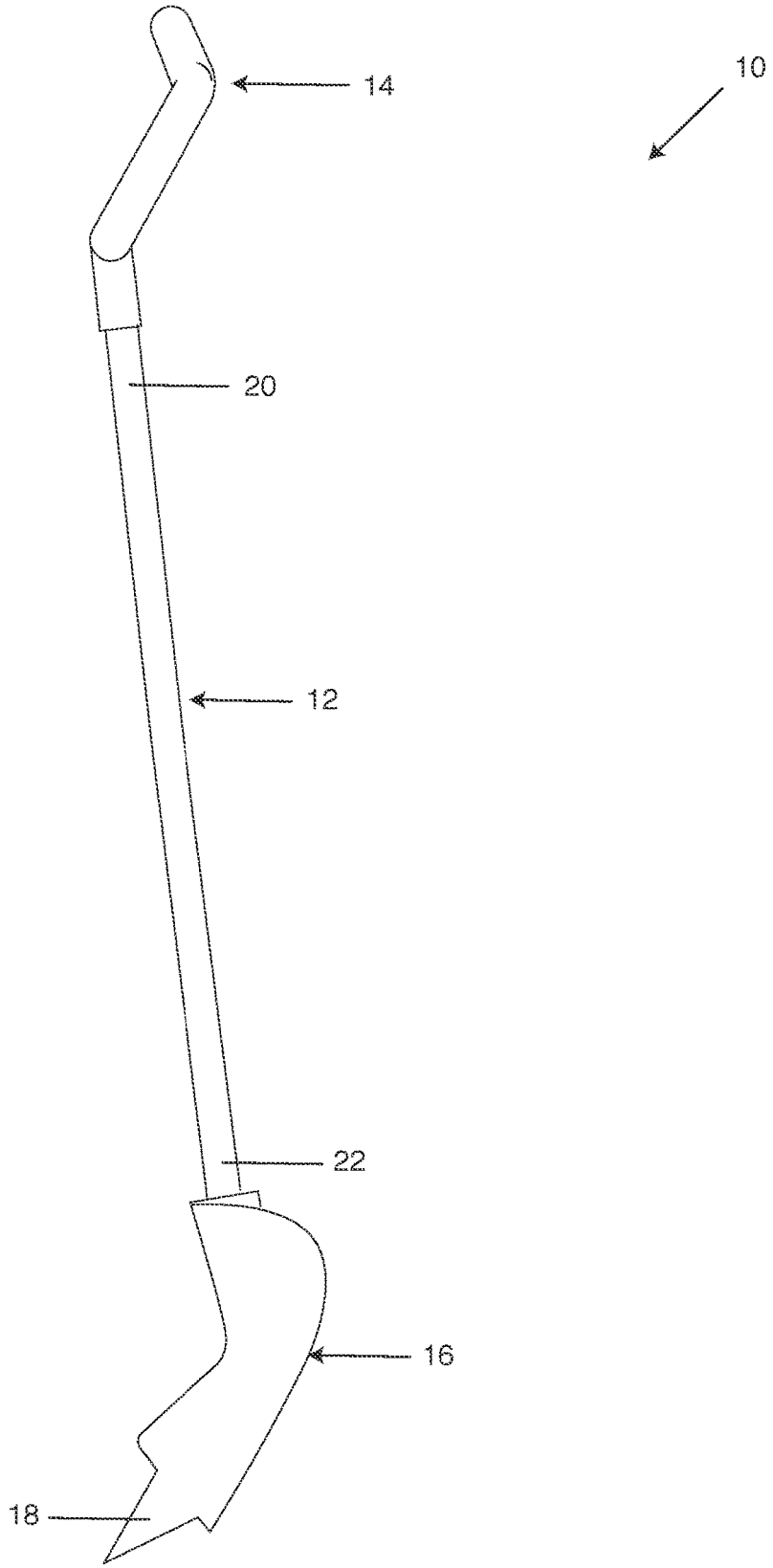
FIG. 9 is a left side view of a shovel assembly fabricated in accordance with the present invention showing the blade implement guide member forming part of a sidewall of the blade implement.

Referring now to FIG. 9, shovel assembly 10 may include a blade implement guide member that forms part of a sidewall of blade implement 16.

Figure 10:
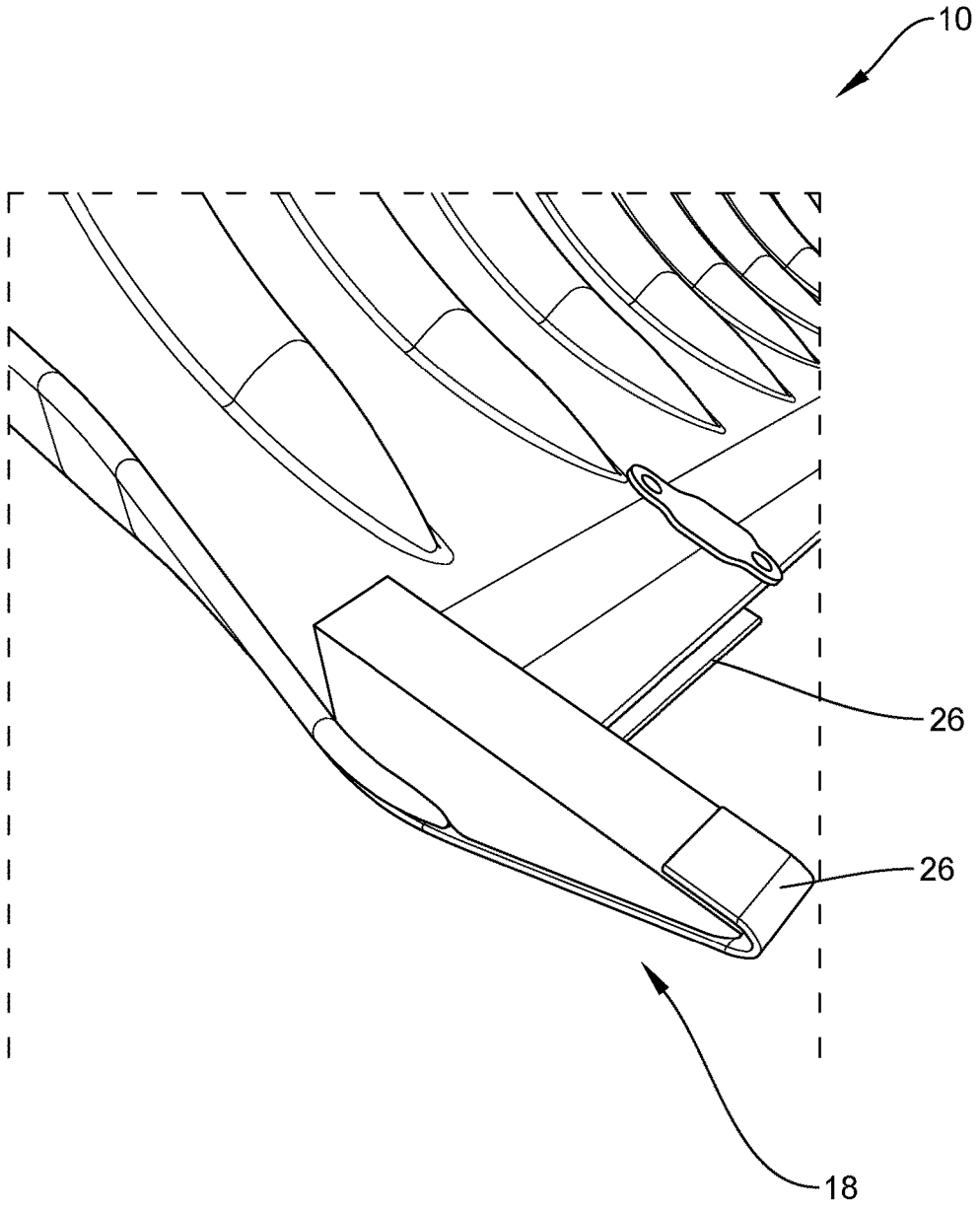
FIG. 10 is a front perspective view of a shovel assembly fabricated in accordance with the present invention showing the blade implement guide member partially covered with a wear strip.

As is shown in FIG. 10, and in a preferred embodiment of the present invention, blade implement guide member 18 is at least partially covered with wear strip 26. Such a wear strip increases the life of shovel assembly 10. In addition, when guide member 18 is covered with wear strip 26, shovel assembly 10, can be used as an ice chip as well. It will be understood that blade implement guide member 18 can be associated with blade implement 16 and/or wear strip 26. It will be further understood that wear strip 26 can serve as a blade implement guide member 18 depending upon its configuration.

Figure 4:
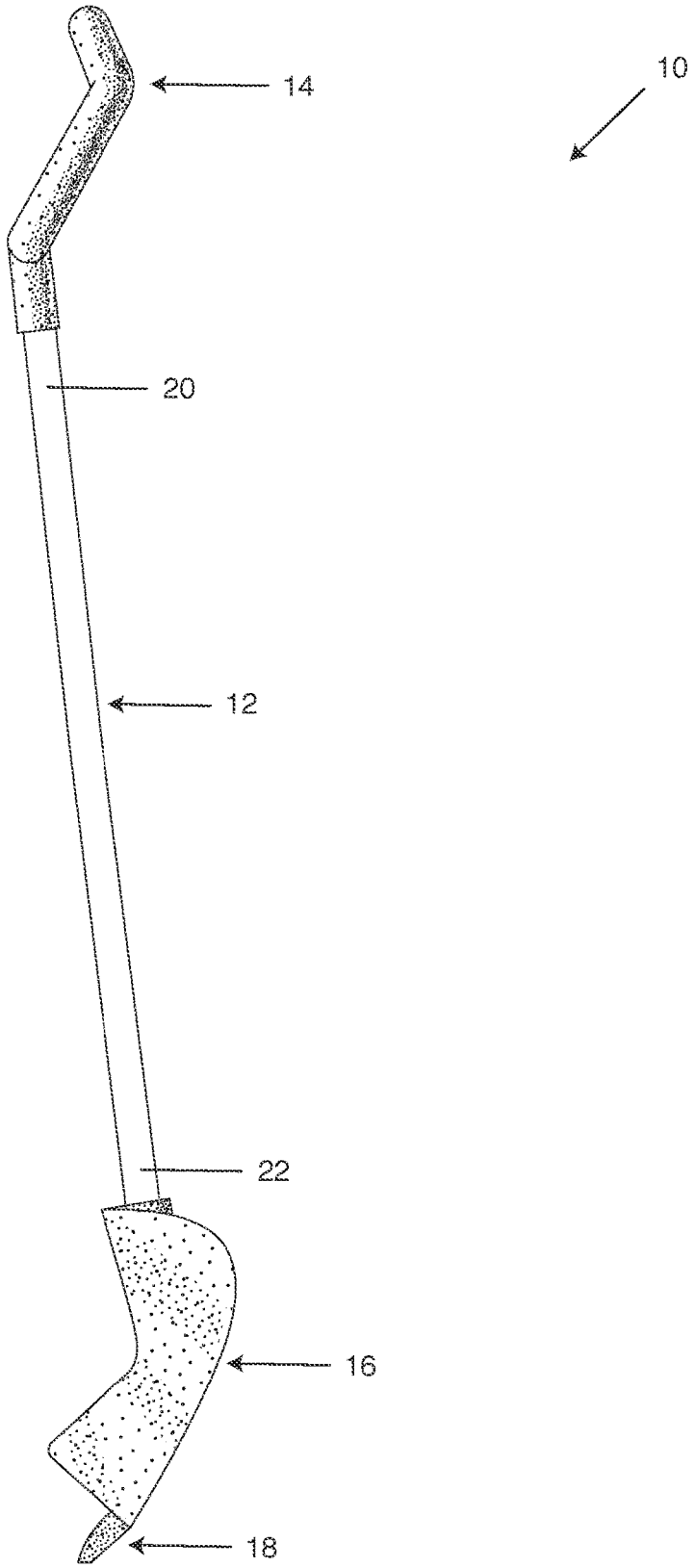
FIG. 4 is a left side view of the shovel assembly of FIG. 1.
Figure 5:
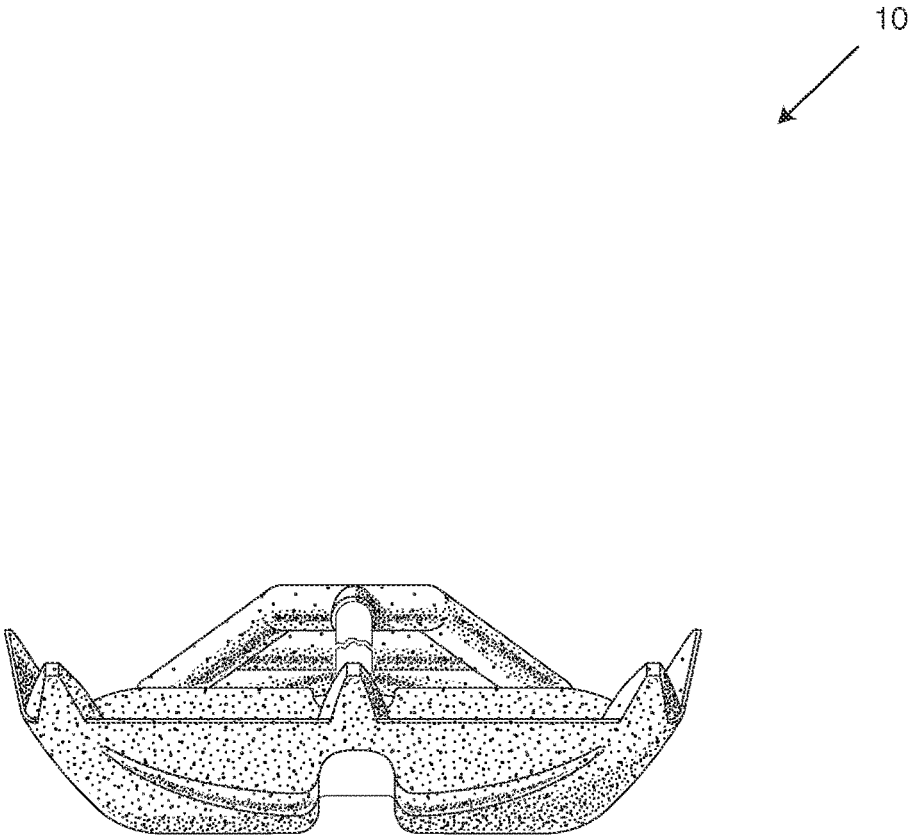
FIG. 5 is a bottom view of the shovel assembly of FIG. 1.
Figure 6:
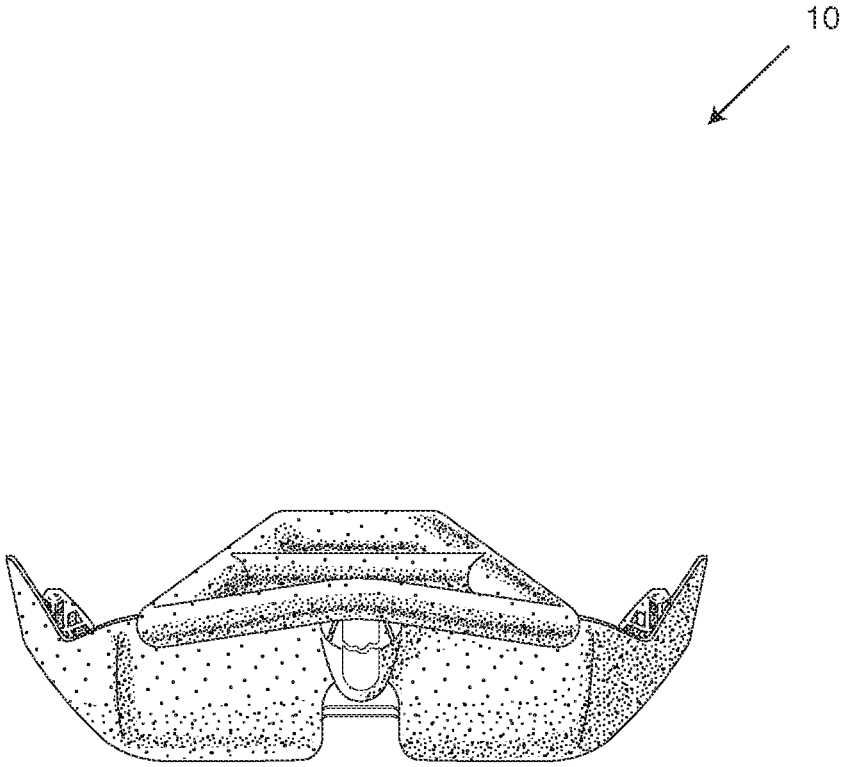
FIG. 6 is a top plan view of the shovel assembly of FIG. 1.

In one embodiment of the present invention, and as is best shown in FIG. 4, the configuration of the handle, blade implement, and blade implement guide member collectively enable a user's vector of force to be directed parallel to the ground—instead of into the ground.

It will be understood that, during normal use, shovel assembly 10 is utilized with a forward push from the user to collect snow and other matter.

The foregoing description merely explains and illustrates the invention and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. A shovel assembly, comprising:

an elongated shaft, wherein the elongated shaft comprises a length, a first proximal end, and a second distal end;

a blade implement, wherein the blade implement includes a top surface, a bottom surface, and a sidewall, and wherein the blade implement is secured to or forms part of the second distal end of the elongated shaft;

a blade implement guide member, wherein the blade implement guide member comprises a bottom surface, a front surface, and a top surface and is positioned proximate the sidewall of the blade implement, wherein the blade implement guide member emanates forward, upward, and away from the bottom surface of the blade implement, and wherein the blade implement guide member enables the removal of snow from uneven surfaces without jarring the operator;

a handle sub-assembly, wherein the handle sub-assembly includes a left side segment that is adapted to engage a user's left hand and a right side segment that is adapted to engage a user's right hand, such that a user's left and right hands are positioned parallel to the bottom surface of the blade implement, and wherein the handle sub-assembly is adapted to direct a user's force parallel to the bottom surface of the blade implement, and, in turn, a ground during normal operation; and an ice chip member, wherein the ice chip member contacts the bottom surface of the blade implement, and the top and bottom surfaces of the blade implement guide member.

2. The shovel assembly according to claim 1, wherein the elongated shaft is fabricated from a material selected from the group consisting of a metal, a natural resin, a synthetic resin, a plastic, a composite, and/or wood.

3. The shovel assembly according to claim 2, wherein the elongated shaft is at least partially coated with a fluorosilicone rubber.

4. The shovel assembly according to claim 1, wherein the handle sub-assembly is secured to or forms part of the first proximal end of the elongated shaft.

5. The shovel assembly according to claim 4, wherein the handle sub-assembly comprises a C-top, D-top, E-top or O-top handle.

6. The shovel assembly according to claim 5, wherein the handle sub-assembly is fabricated from a material selected from the group consisting of a metal, a natural resin, a synthetic resin, a plastic, a composite, and/or wood.

7. The shovel assembly according to claim 6, wherein the handle sub-assembly is at least partially coated with at least one shock absorbing material selected from the group consisting of a natural polyisoprene, a synthetic polyisoprene, a polybutadiene, a chloroprene rubber, a butyl rubber, a halogenated butyl rubber, a styrene-butadiene rubber, a nitrile rubber, a hydrogenated nitrile rubber, an ethylene propylene rubber, an ethylene propylene diene rubber, an epichlorohydrin rubber, a polyacrylic rubber, a silicone rubber, a fluorosilicone rubber, a fluoroelastomer, a perfluoroelastomer, a polyether block amide, a chlorosulfonated, ethylene-vinyl acetate, a resilin, an elastin, a polysulfide rubber, an elastolefin, and combinations thereof.

8. The shovel assembly according to claim 1, wherein the blade implement is fabricated from a material selected from the group consisting of a metal, a natural resin, a synthetic resin, a plastic, a composite, and/or wood.

9. The shovel assembly according to claim 8, wherein the blade implement is at least partially coated with a non-stick agent.

10. The shovel assembly according to claim 9, wherein the non-stick agent is selected from the group consisting of a polytetrafluoroethylene and/or fluorinated ethylene propylene.

* * * * *